US005198288A

United States Patent [19]

Grunfeld

[11] Patent Number: 5,198,288

[45] Date of Patent: Mar. 30, 1993

[54] KNIT FABRIC WITH ELASTIC COMBINATION YARN

[75] Inventor: Albert J. Grunfeld, Wilmington, Del.

[73] Assignee: E. I. Du Pont de Nemours and Company, Wilmington, Del.

[21] Appl. No.: 841,808

[22] Filed: Feb. 26, 1992

[51] Int. Cl.[5] ..... B32B 7/00

[52] U.S. Cl. ..... 428/253; 66/8; 66/10; 66/171; 66/202; 428/230; 428/231

[58] Field of Search ..... 428/230, 231, 253; 66/8, 10, 171, 202

[56] References Cited

U.S. PATENT DOCUMENTS

| | | | |
|---|---|---|---|
| 3,392,552 | 7/1968 | Muller et al. | 66/169 |
| 3,940,917 | 3/1976 | Strachan | 57/152 |
| 5,050,406 | 9/1991 | Strauss et al. | 66/177 |

FOREIGN PATENT DOCUMENTS 38-50045 9/1963 Japan .

*Primary Examiner*—James J. Bell

[57] ABSTRACT

A knit fabric with improved machine working loss and dimensional stability has an elastic combination yarn of 10% to 70% elongation incorporated into the fabric. The combination yarn comprises spandex which amounts to 0.2 to 3.5% of the fabric weight.

5 Claims, No Drawings

KNIT FABRIC WITH ELASTIC COMBINATION YARN

BACKGROUND OF THE INVENTION

1. Field of the Invention

The present invention relates to a knit fabric made with non-elastic yarn and a minor weight fraction of elastic combination yarns. More particularly, the invention concerns such a knit fabric in which the combination yarn has an elastic elongation of 10% to 70% and provides improved fabrication, shape-retention and appearance to fabric knit therewith.

2. Description of the Prior Art

Knit fabrics which contain non-elastic textile yarns and a minor fraction of elastic combination yarns are known. Such fabrics are used for sweaters, socks and the like. For example, Strauss et al, U.S. Pat. No. 5,050,406, discloses a knit fabric that comprises 30% core-spun combination yarn, in which the yarn is 90% cotton and 10% spandex. Also, Muller et al, U.S. Pat. No. 3,392,552, describes a knit fabric, in which at least 20% of the ends are of elastic yarn plied with inelastic yarn.

Various types of elastic combination yarns are known, such as covered, core-spun, plied, core-effect, plaited, air-jet-entangled and like yarns. In such yarns, elastic filaments are combined with non-elastic textile yarns by known techniques. In the manufacture of some combination yarns, the elastomeric components are stretched during combination with inelastic yarn. For example, Strachan, U.S. Pat. No. 3,940,917, discloses a spandex yarn being stretched at least 100%, usually 250 to 500%, during air-jet entanglement with inelastic filaments, and Miyasaka, Japanese Patent Application 38-50045, discloses an elastic yarn being stretched 50% during a similar entanglement procedure.

Although non-elastic textile yarns and elastic combination yarns have been used together in various knit fabrics, the utility of such fabrics in manufactured garments such as sweaters, socks, and the like, has been somewhat limited. Incorporation of elastic combination yarns into such fabrics often resulted in undesirable "working loss" (i.e., area contraction) in the fabrics immediately after the fabric was removed from the knitting machine on which the fabric was made. However, various garments knit from natural fibers, such as cotton and wool, without any elastic yarns in the fabric, often suffer problems of shape distortion during finishing, cleaning and storage.

An object of this invention is to provide an improved knit fabric in which the problems of working loss and shape distortion are significantly decreased.

SUMMARY OF THE INVENTION

The present invention provides an improved knit fabric, particularly suited for the manufacture of sweaters, socks, skirts, dresses and the like. The knit fabric is of a known type that comprises inelastic yarn and elastic combination yarn. In accordance with the improvement of the present invention, the elastic combination yarn has an elastic stretch in the range of 10 to 70% and comprises by weight in the range of 5 to 20% elastomeric fiber and 95 to 80 weight conventional textile fiber. For sweater fabric, the elastic combination yarn preferably amounts to in the range of 2.5 to 5% of the total weight of the fabric and the total spandex content of the fabric is preferably in the range of 0.2 to 0.6%.

For sock fabric, the elastic combination yarn content is preferably in the range of 10 to 40% and the total spandex content of the fabric is preferably in the range of 1 to 3.5%. The fabrics can be made on weft-knitting or circular-knitting machines.

DETAILED DESCRIPTION OF PREFERRED EMBODIMENTS

For convenience and clarity, definitions will now be given of several terms that are used herein, and where appropriate how the quantity to which the term refers is measured.

A "combination yarn" is a yarn that has at least two dissimilar yarn components, one of which is elastic and another of which is of conventional, natural or synthetic, textile fiber, such as cotton, wool, nylon, polyester or the like. "Spandex" is a manufactured fiber in which the fiber-forming substance is a long chain synthetic polymer comprised of at least 85% by weight of a segmented polyurethane. The term "fiber" includes in its meaning staple fibers and continuous filaments. The term "elastic" refers to the property of fiber or yarn to stretch under tension and retract quickly and forcibly to substantially its original length when the tension is removed. The term "stitch distortion" describes undesired yarn jamming in knit stitches, which occurs when a knit elastic combination yarn retracts with too much force. In describing a sock, "leg" refers to the portion of a sock that is located between the heel and cuff (or the top opening if the sock has no cuff) and "foot" refers to the portion between the toe and the heel.

"Working loss" is the area contraction that occurs when a knit fabric is removed from the knitting machine on which it was made (i.e., the area of the fabric in an untensioned state immediately after removal from the knitting machine divided by the area of the as-knit fabric on the knitting machine). Large working losses often occur when fabrics are knit with high-elongation yarns under high tension. Such operation causes the fabric to shrink when it is released from the restraining force of the knitting machine. Working loss is economically disadvantageous and results in heavier-than-desired fabrics, use of excessive amounts of yarn, and the need for several trial-and-error runs to correct the undesired condition. A convenient measure of working loss in knit sock fabrics is the contraction in length of the sock when it is removed from the knitting machine.

The term "shape distortion", as used herein, refers to the dimensional changes that occur in knit fabrics as a result of washing, drying and hanging. The resistance of a knit fabric to shape distortion is measured as follows. A knit sweater blank test fabric is suspended for 24 hours from its top edge with no added weight and then washed. The fabric is washed in an 18-gallon automatic washer with 28 grams of "Tide" powdered detergent. The washing includes 10 minutes of agitation with water at a temperature of 100° F. in a wash cycle and two rinse cycles with cold water with one minute of agitation in each rinse cycle. The sweater sample was then tumble-dried at a standard "cotton" setting (140° F. to 160° F.) for 60 minutes. The change in area, reported as a percent loss in original area of the sweater blank, is a measure of the ability of the fabric to retain its shape and avoid distortion.

Stitch distortion in knit sweater blanks is rated visually on a scale of 1 to 5, with 5 being best, 3 satisfactory and 1 unacceptable. Sweater blanks made with 100% cotton yarns have the best stitch definition and least stitch distortion and are therefore rated 5 and used as a stitch-rating standard to which other fabrics are compared.

The elastic component of yarns that are suitable for use in the present invention includes yarns of rubber, spandex or other elastomeric fiber. The elastic component can be covered, plaited, core-ply spun, air-jet entangled, air-jet intermingled, or the like, with conventional textile fibers to form the elastic combination yarn. The conventional textile fibers include, among others, cotton, wool, nylon, polyester, or other natural or synthetic fibers. For example, in a preferred embodiment of the invention, a single end of spandex is combined with one or two ends of stretch-textured nylon yarn, while the spandex is under a draft of 1.1X to 1.7X, to form a combination yarn that has an elastic stretch of about 10% to 70% (beyond its original length). Such elastic combination yarns are shown in the examples below to provide improved knit fabrics for cotton sweaters and socks.

To prepare a fabric of the invention, the elastic combination yarns and conventional textile fiber yarns are knit on a weft-knitting or a circular-knitting machine. In typical knit constructions of the invention, the elastic combination yarn can be knit in every stitch, in two out of three stitches, or at least in every other stitch. Alternatively, the elastic combination yarn can be plaited or laid in the knit fabric.

The knit fabrics of the invention are particularly suited for the manufacture of sweaters, socks, skirts, dresses and the like. The fabrics of the invention generally have unit weights that are greater than about 6 oz/yd$^2$ (200 g/m$^2$) and preferably, greater than about 10 oz/yd$^2$ (340 g/m$^2$).

EXAMPLES

The following Examples, which describe preferred fabrics of the invention, are included for illustration and are not intended to limit the scope of the invention, which scope is defined by the appended claims. In the examples, fabric samples of the invention are designated with Arabic numerals and comparison samples are designated with upper case letters.

In Examples I, II and III, the fabrication and testing of various weft-knit cotton sweater fabrics made according to the invention with elastic combination yarns having an elastic stretch of 10 to 70% are compared with similar fabrics outside the invention made without such elastic combination yarns or with combination yarns that have excessive elastic stretch. Examples IV and V present similar comparisons for circular-knit cotton socks. The Examples clearly demonstrate the advantages of the invention in decreasing working loss and in preventing excessive shape distortion during washing, drying and hanging.

Several elastic combination yarns were prepared for use in the fabrics of the examples. The yarns, which are described in the following table, were formed with one end of spandex (i.e., "Lycra" available from E. I. du Pont de Nemours & Co.) of 10 or 20 denier (11 or 22 dtex) and one or two ends of conventional stretch-textured 70-den (77-dtex) nylon yarn by air-jet entanglement techniques. Equipment similar to that disclosed in U. S. Pat. No. 3,940,917 was employed. The spandex was elongated during the air-jet entangling operation and then wound up in the elongated condition. The elongation is expressed as a draft ratio (labeled "draft" in the table). The feed of textured nylon yarn was adjusted to provide the final combination yarn with the total denier listed in the table. The total denier is for the combination yarn in the wound up state (i.e., at an elongation corresponding to the spandex draft during the combining operation). The percent elastic stretch in the resultant combination yarn and the weight percent spandex therein (determined by weighing) are also listed in the table. Note that yarns designated Y-1 through Y-7 are suitable for use in the fabrics of the invention and that yarns Y-a, Y-b and Y-c are for comparison fabrics that are outside the invention. Each of the combination yarns were made with 20-den (22-dtex) spandex, except yarns Y-5, Y-6, Y-7 and Y-c, which were made with 10-den (11-dtex) spandex; all were made with one end of the nylon yarn, except yarns Y-3, Y-4 and Y-b, which were made with two nylon yarn ends.

| | Wound-up Combination Yarn | | | |
|---|---|---|---|---|
| Yarn | Spandex Draft | Weight % Spandex | Total denier | % Elastic Stretch |
| 20-den spandex, 1 nylon end | | | | |
| Y-1 | 1.1 | 17.6 | 103 | 10 |
| Y-2 | 1.7 | 12.1 | 97 | 70 |
| Y-a | 2.9 | 7.5 | 92 | 190 |
| 20-den spandex, 2 nylon ends | | | | |
| Y-3 | 1.1 | 9.6 | 189 | 10 |
| Y-4 | 1.7 | 6.5 | 181 | 70 |
| Y-b | 3.0 | 3.8 | 175 | 200 |
| 10-den spandex, 1 nylon end | | | | |
| Y-5 | 1.1 | 9.3 | 98 | 10 |
| Y-6 | 1.4 | 7.5 | 95 | 40 |
| Y-7 | 1.7 | 6.2 | 95 | 70 |
| Y-c | 2.4 | 4.4 | 95 | 140 |

The above-described combination yarns and certain cotton yarns were used to knit fabrics, as described in each example, below. In each of the examples, the fabrics were knit with the elastic combination yarns under tension at their drafted extensions. Equal tensions were employed with the cotton yarns and combination yarn. Unless indicated otherwise, the elastic combination yarn was plaited with the conventional cotton yarns when being knit into fabric.

Examples I, II and III demonstrate the advantage of the fabrics of the invention in decreasing working loss and while preventing excessive shape distortion caused by washing, tumble drying and hanging.

EXAMPLE I

Seven sweater fabric blanks of cable links construction were weft knit; four samples according to the invention (1–4) and three comparison samples (A, B, C). In each fabric, four ends of a 14/2 cotton count yarn (total denier of the 4 ends was 3037) and one end of the elastic combination yarn were employed, except that comparison sample A contained no elastic combination yarn. Needle spacing and course spacing were each five per inch. Needle bed width and knitting tension were constant Fabric weight varied from 13.5 oz/yd$^2$ (458 g/m$^2$) for Sample A (100% cotton) to 19.0 oz/yd$^2$ (644 g/m$^2$) for Sample B (cotton and yarn Y-a). For each sample, Table 1 lists the particular elastic combination yarn used, the calculated weight % of spandex and of elastic combination yarn, the working loss (% area decrease), the % area loss in the hang, wash and dry shape-retention test and the stitch distortion rating.

TABLE 1

| Fabric Sample | Elastic Comb. Yarn | (Example I) Weight % in Fabric Elastic Comb. | Spandex Yarn | Working Loss, % | Shape Test % Loss | Stitch Rating |
|---|---|---|---|---|---|---|
| A | none | none | none | none | 13 | 5 |
| 1 | Y-2 | 3.1 | 0.38 | 23 | 7 | 2 |
| B | Y-a | 2.9 | 0.22 | 28 | 4 | 2 |
| 2 | Y-5 | 3.1 | 0.29 | 18 | 9 | 5 |
| 3 | Y-6 | 3.0 | 0.23 | 24 | 9 | 3 |
| 4 | Y-7 | 3.0 | 0.19 | 24 | 7 | 3 |
| C | Y-c | 3.0 | 0.13 | 26 | 4 | 2 |

EXAMPLE II

In this example, seven sweater fabric blanks of cable pointel construction were weft knit using the same elastic combination yarns as in Example I. Four samples were according to the invention (5–8) and three were comparison samples (D, E, F). In each fabric, three ends of a 16/2 cotton count yarn (total denier of the 3 ends was 1998) and one end of the elastic combination yarn were employed, except that comparison sample D contained no elastic combination yarn. Needle spacing and course spacing were each seven per inch. Needle bed width and knitting tension were constant. Fabric weight varied from 12.8 oz/yd$^2$ (434 g/m$^2$) for Sample D (100% cotton) to 19.5 oz/yd$^2$ (661 g/m$^2$) for Sample E (cotton and yarn Y-a). For each sample, Table 2 below lists the same items as were listed in Table 1.

TABLE 2

| Fabric Sample | Elastic Comb. Yarn | (Example II) Weight % in Fabric Elastic Comb. | Spandex Yarn | Working Loss, % | Shape Test % Loss | Stitch Rating |
|---|---|---|---|---|---|---|
| D | none | none | none | none | 7 | 5 |
| 5 | Y-2 | 4.6 | 0.56 | 28 | 3 | 1 |
| E | Y-a | 4.4 | 0.33 | 34 | 1 | 2 |
| 6 | Y-5 | 4.7 | 0.43 | 25 | 4 | 4 |
| 7 | Y-6 | 4.5 | 0.34 | 23 | 4 | 3 |
| 8 | Y-7 | 4.5 | 0.28 | 26 | 5 | 3 |
| F | Y-c | 4.4 | 0.20 | 28 | 3 | 2 |

EXAMPLE III

In this example, seven sweater fabric blanks of cable moving construction were weft knit using the same elastic combination yarns as in Example I. Four samples were according to the invention (9–12) and three were comparison samples (G, H, I). In each fabric, five ends of a 20/2 cotton count yarn (total denier of the 5 ends was 2658) and one end of the elastic combination yarn were employed, except that comparison sample G contained no elastic combination yarn. Needle spacing and course spacing were each five per inch. Needle bed width and knitting tension were constant. Fabric weight varied from 13.9 oz/yd$^2$ (471 g/m$^2$) for Sample G (100% cotton) to 22.6 oz/yd$^2$ (766 g/m$^2$) for Sample H (cotton and yarn Y-a). For each sample, Table 3 below lists the same items as were listed in Tables 1 and 2.

TABLE 3

| Fabric Sample | Elastic Comb. Yarn | (Example III) Weight % in Fabric Elastic Comb. | Spandex Yarn | Working Loss, % | Shape Test % Loss | Stitch Rating |
|---|---|---|---|---|---|---|
| G | none | none | none | none | 16 | 5 |
| 9 | Y-2 | 3.5 | 0.43 | 27 | 6 | 3 |
| H | Y-a | 3.3 | 0.25 | 39 | 2 | 1 |

TABLE 3-continued

| Fabric Sample | Elastic Comb. Yarn | (Example III) Weight % in Fabric Elastic Comb. | Spandex Yarn | Working Loss, % | Shape Test % Loss | Stitch Rating |
|---|---|---|---|---|---|---|
| 10 | Y-5 | 3.6 | 0.33 | 21 | 5 | 4 |
| 11 | Y-6 | 3.5 | 0.26 | 24 | 8 | 4 |
| 12 | Y-7 | 3.5 | 0.21 | 31 | 7 | 2 |
| I | Y-c | 3.5 | 0.15 | 32 | 5 | 1 |

Note that each weft-knit sweater fabric construction of Examples I, II and III, that contained elastic combination yarns in accordance with the invention having a draft of less than 1.7X exhibited less working loss than fabrics made with combination yarns of higher draft. The fabrics according to the invention also exhibited shape retention characteristics that compared favorably with those of the fabrics made with higher draft combination yarns as well as adequate stitch distortion ratings.

EXAMPLES IV AND V

In Example IV, six sock fabrics were knit; four according to the invention (13–16) and two comparison samples (K,J). In Example V, three sock fabrics of the invention (17–19) and one comparison sample (L) were knit. For each fabric of Example IV, five ends of a 20/2 cotton count yarn (total denier of the 2 ends was 885) and one end of elastic combination yarn were knit on an 84-needle circular knitting machine at constant knitting tension and with the same number of courses, to form a 2×1 rib knit construction. For fabrics of Example V, one end a 30/1 cotton count yarn of 177 denier and one end of elastic combination yarn were knit on a 200-needle circular knitting machine at constant knitting tension and with the same number of courses to form socks of 1×1 rib knit construction. Table 4 below identifies the particular combination yarns that were employed and lists the weight percent of the fabric that was combination yarn and that was spandex. The working loss of the resultant socks is indicated in terms of sock leg length (in inches). The longer the leg length, the less working loss.

TABLE 4

| Fabric Sample | Elastic Comb. Yarn | (Examples IV and V) Weight % in Fabric Elastic Comb. | Spandex Yarn | Length of Leg (inches) |
|---|---|---|---|---|
| Example IV | | | | |
| 13 | Y-1 | 10.4 | 1.8 | 11.5 |
| 14 | Y-2 | 9.9 | 1.2 | 11.5 |
| J | Y-a | 9.4 | 0.7 | 9.5 |
| 15 | Y-3 | 17.6 | 1.7 | 11.5 |
| 16 | Y-4 | 17.0 | 1.1 | 11.0 |
| K | Y-b | 16.5 | 0.6 | 9.5 |
| Example V | | | | |
| 17 | Y-5 | 35.6 | 3.3 | 8.0 |
| 18 | Y-6 | 34.9 | 2.6 | 7.8 |
| 19 | Y-7 | 34.9 | 2.2 | 7.3 |
| L | Y-c | 34.9 | 1.5 | 7.0 |

The results summarized in Table 4 clearly demonstrate the advantageously lower working loss for fabrics made with elastic combination yarns in which the spandex component of the combination yarn was not drafted more than 1.7X during its production.

I claim:

1. An improved weft knit or circular knit fabric, particularly suited for use as a sweater fabric or a sock fabric, comprising inelastic yarn and elastic combination yarn, characterized in that the elastic combination yarn has an elastic stretch in the range of 10 to 70% and comprises in the range of 95 to 80 weight percent inelastic fiber and 5 to 20% elastic fiber.

2. A fabric of claim 1 wherein the elastic fiber is spandex.

3. A sweater fabric in accordance with claim 2, wherein the fabric is a weft-knit fabric, the elastic combination yarn amounts to in the range of 2.5 to 5% of the total weight of the fabric and the spandex content of the fabric is in the range of 0.2 to 0.6%.

4. A sock fabric in accordance with claim 2, wherein the fabric is a circular-knit fabric, the elastic combination yarn amounts to in the range of 10 to 40% of the total weight of the fabric and the spandex content of the fabric is in the range of 1 to 3.5%.

5. A process for knitting a fabric particularly suited for sweater fabric or sock fabric comprising feeding an elastic combination yarn and conventional textile fiber yarn to a weft knitting or circular knitting machine, the elastic combination yarn having an elastic stretch in the range of 10 to 70 percent and comprising 5 to 20 percent of the total weight of all yarns fed, maintaining about equal tension on the elastic combination yarn and the conventional textile yarn, and adjusting the tension to be sufficient to fully extend the combination yarn in the range of 01 to 70 percent.

* * * * *

UNITED STATES PATENT AND TRADEMARK OFFICE

CERTIFICATE OF CORRECTION

PATENT NO. : 5,198,288

DATED : March 30, 1993

INVENTOR(S) : Albert John Grunfeld

It is certified that error appears in the above-identified patent and that said Letters Patent is hereby corrected as shown below:

Column 8, line 14, please change "01" to read -- 10 --.

Signed and Sealed this

Thirty-first Day of May, 1994

Bruce Lehman

*Attest:*

BRUCE LEHMAN

*Attesting Officer*

*Commissioner of Patents and Trademarks*